United States Patent [19]

Bradley

[11] Patent Number: 5,071,002

[45] Date of Patent: Dec. 10, 1991

[54] INVERTIBLE HOLDER FOR CONTAINERS

[76] Inventor: Donald S. Bradley, 16143 Little Cypress, Cypress, Tex. 77429

[21] Appl. No.: 383,418

[22] Filed: Jul. 24, 1989

[51] Int. Cl.[5] ..... B65D 71/00; B01L 9/06

[52] U.S. Cl. ..... 206/217; 206/822; 248/311.2; 248/152; 211/72; 211/77; 220/738; 220/737

[58] Field of Search ..... 206/217, 822; 220/85 H, 220/903, 410, 69; 215/100 R; 229/1.5 H; 248/311.2, 152; D7/70; 211/71, 72, 74, 75, 77

[56] References Cited

U.S. PATENT DOCUMENTS

| | | | |
|---|---|---|---|
| D. 6,731 | 4/1947 | Vaccarello | D 7/70 X |
| 1,915,958 | 6/1933 | Skirrow | 229/1.5 H |
| 2,808,191 | 10/1957 | Cramer | 206/217 X |
| 3,163,287 | 12/1964 | Barnett | 220/69 X |
| 3,379,315 | 4/1968 | Broadwin | 211/74 X |
| 3,497,057 | 2/1970 | Traner et al. | 206/499 X |
| 4,020,986 | 5/1977 | McAtee | 224/42.42 X |
| 4,482,522 | 11/1984 | Baudisch et al. | 211/74 X |
| 4,693,440 | 9/1987 | Lalonde | 220/85 H X |
| 4,700,849 | 10/1987 | Wagner | 211/71 |
| 4,762,210 | 8/1988 | Bortani | 206/217 X |
| 4,947,991 | 8/1990 | Snell | 211/74 X |
| 4,966,241 | 10/1990 | Luchinger et al. | 211/74 X |

*Primary Examiner*—Paul T. Sewell
*Assistant Examiner*—Jacob K. Ackun, Jr.
*Attorney, Agent, or Firm*—Neal J. Mosely

[57] ABSTRACT

A multi-sided, invertible holder for beverage containers or the like comprises a hollow receptacle with a plurality of pairs of flat sides. A preferred embodiment is a hollow cube configuration having six flat sides. Four sides have holes through side walls; one side has a slot extending the length of the side wall; and another side has a hole through the side wall and a slot extending radially outward from the hole, and another side has a solid side wall. In use, the holder sits on a generally level surface and may be inverted such that any one of the side walls is on the top side to slidably receive a beverage container or other open top receptacle while the opposed bottom flat surface provides a stable supporting base. The invertible holder provides sufficient stability to prevent tipping or spilling the contents of the container. The plurality of apertured sides allow the holder to accomodate various sizes and shapes of beverage containers including cylindrical, tapered, or square beverage containers, or containers having handles.

1 Claim, 2 Drawing Sheets

INVERTIBLE HOLDER FOR CONTAINERS

BACKGROUND OF THE INVENTION

1.Field of the Invention

This invention relates generally to holders for open top receptables, and more particularly to a hollow invertible holder for accomodating various size and shaped beverage containers or the like.

2. Brief Description of the Prior Art

Persons frequently drink beverages when driving vehicles. Common containers for beverages come in a wide range of sizes and shapes, such as cardboard or styrofoam cups, insulated containers, and cups or containers having various handle configurations. Various holders have been designed to fit inside the vehicle, such as on the console, the center hump, on the dash, or on the door panel, and have a receptacle to hold the beverage container. Some vehicles have a console having one or more receptacles to hold a beverage container. Prior art holders for beverage containers usually have one or more receptacles of one diameter which will accept only certain size beverage containers and/or containers which have no handles.

A problem exists when the holder receptacle is not the proper size or shape for the beverage container being used at the time. There are several patents which disclose various coasters and holders.

Kelley, U.S. Pat. No. 164,692 discloses a design for a bottle holder which is received on the door side panel of vehicles and has a single receptacle.

Wilson, U.S. Pat. No. 261,592 discloses a design for a coaster holder for a beverage container.

Rasler, U.S. Pat. No. 4,383,669 discloses an invertible carrier for tools, painter's supplies, and the like having two tray-like receptacles of different depths having a common planar bottom.

St. Cyr, U.S. Pat. No. 3,028,702 discloses a non-tipping drinking class coaster which has a weighted bottom and a single receptacle for beverage glasses.

The present invention is distinguished over the prior art in general, and these patents in particular by a multi-sided invertible holder for containers which comprises a hollow receptacle with a plurality of pairs of flat sides. A preferred embodiment is a hollow cube configuration having six flat sides. Four sides have holes through side walls; one side has a slot extending the length of the side wall; and another side has a hole through the side wall and a slot extending radially outward from the hole, and another side has a solid side wall. In use, the holder sits on a generally level surface and may be inverted such that any one of the side walls is on the top side to slidably receive a container while the opposed bottom flat surface provides a stable supporting base. The invertible holder provides sufficient stability to prevent tipping or spilling the contents of the container. The plurality of apertured sides allow the holder to accomodate various sizes and shapes of containers including cylindrical, tapered, or square containers, or containers having handles.

SUMMARY OF THE INVENTION

It is therefore an object of the present invention to provide a container holder which may be inverted for accomodating a wide range of sizes and shapes of containers.

It is another object of this invention to provide an invertible holder for containers which will accept containers having handles.

Another object of this invention is to provide an invertible holder for containers which will accept cylindrical, tapered, or square containers.

Another object of this invention is to provide an invertible holder for containers which has a flat supporting surface to provide stability and reduce the chances of tipping or spilling the contents.

A further object of this invention is to provide an invertible holder for containers which is simple in design, economical to manufacture, and rugged and durable in use.

Another object of this invention is to provide a hollow, multi-sided, invertible holder for containers which will accept containers having handles.

Another object of this invention is to provide a hollow, multi-sided, invertible holder for containers which will accept cylindrical, tapered, or square containers.

Another object of this invention is to provide a hollow, multi-sided, invertible holder for containers which has a flat supporting surface to provide stability and reduce the chances of tipping or spilling the contents.

Another object of this invention is to provide a hollow, multi-sided, invertible holder for containers comprising a hollow receptacle with a plurality of pairs of flat sides.

Other objects of the invention will become apparent from time to time throughout the specification and claims as hereinafter related.

The above noted objects and other objects of the invention are accomplished by a multi-sided, invertible holder for containers comprising a hollow receptacle with a plurality of pairs of flat sides. A preferred embodiment is a hollow cube configuration having six flat sides. Four sides have holes through side walls; one side has a slot extending the length of the side wall; and another side has a hole through the side wall and a slot extending radially outward from the hole, and another side has a solid side wall. In use, the holder sits on a generally level surface and may be inverted such that any one of the side walls is on the top side to slidably receive a container while the opposed bottom flat surface provides a stable supporting base. The invertible holder provides sufficient stability to prevent tipping or spilling the contents of the container. The plurality of apertured sides allow the holder to accommodate various sizes and shapes of containers including cylindrical, tapered, or square beverage containers, or containers having handles.

DESCRIPTION OF THE PREFERRED EMBODIMENT

Figure 1:
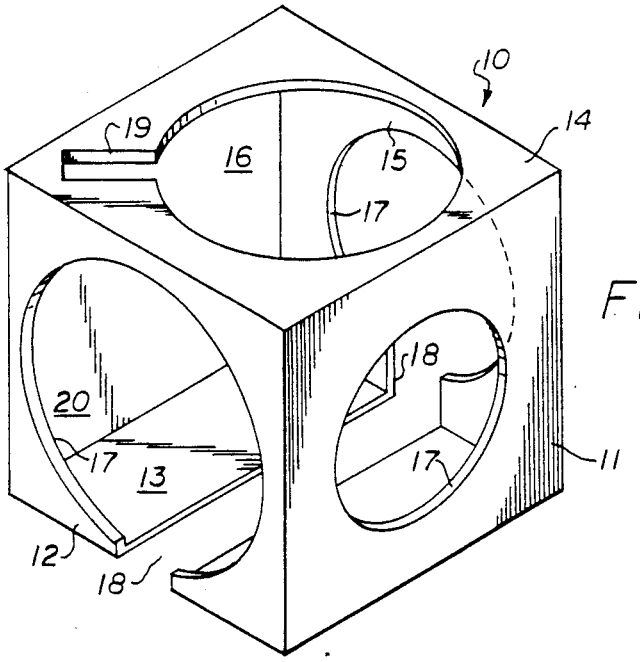
FIG. 1 is an isometric view of an invertible holder for containers in accordance with the present invention.
Figure 2:
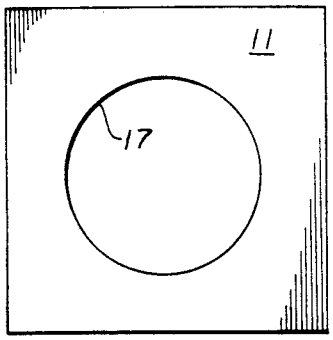
FIG. 2–7 are top plan views of the various sides of the invertible holder of FIG. 1.
Figure 3:
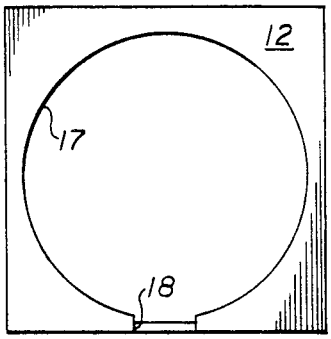
Figure 4:
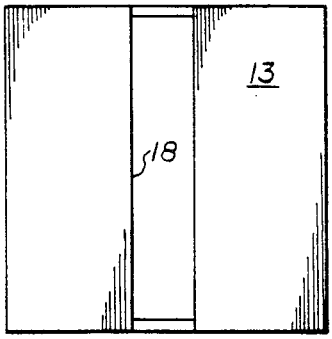
Figure 5:
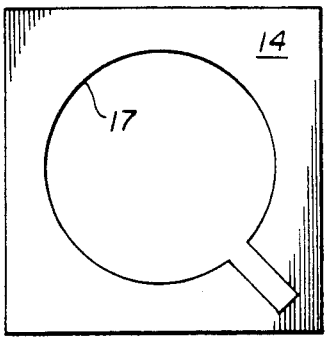
Figure 6:
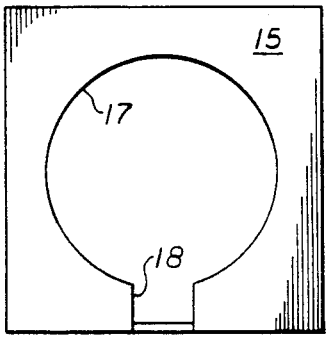
Figure 7:
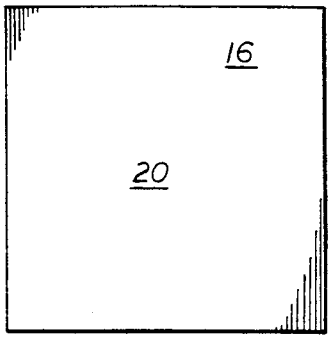

Referring to the drawings by numerals of reference, there is shown in FIG. 1, a preferred invertible holder 10 for containers, especially beverage containers or the like, comprises a hollow receptacle with a plurality of pairs or flat parallel sides or faces, one of which can rest on a surface while the other parallel face forms a top surface or wall. A preferred embodiment is a polyhedral configuration, such as a hollow cube construction. Other usable shapes having pairs of parallel walls or surfaces include a rectangular parallelapiped, a prism shape with parallel end and parallel side walls, a sphere cut or shaped to have a plurality of pairs or parallel walls, etc.

As shown in FIGS. 2–7, a preferred embodiment of the holder 10 is a hollow cube having six flat sides designated 11 –16. Four of the sides have circular apertures or holes 17 through the hollow holder side walls. Side 11 has a hole 17 through the side wall. Side 12 has a larger hole 17 through the side wall, and a slot 18 extends radially outward from the hole 17 toward the center of the adjacent side wall. Side 13 has a slot 18 which extends the length of the side wall. Side 14 has a hole 17 through the side wall, and a small slot 19 extends radially outward from the hole 17 toward the corner of the side wall. Side 15 has a relatively small hole 17 through the side wall, and a slot 18 extends radially outward from the hole 17 toward the center of the adjacent side wall. Side 16 is a solid side wall 20, although it could have a hole or slot, if desired. These described apertured surfaces are illustrative of a preferred embodiment, and it should be understood that other combinations may be incorporated without departing from the scope of the are present invention.

In use, the hollow holder may be inverted such that any one of the side walls is on the top side to slidably receive a container, e.g., a beverage container or the like, while the bottom flat surface provides a stable supporting base. The bottom side of the hollow holder 10 will rest on any convenient generally flat or level surface, such as on or in a vehicle console or tray. The hollow holder 10 may also be placed on on the seat of a vehicle, and provides sufficient stability to prevent tipping or spilling the contents of the container.

Figure 8:
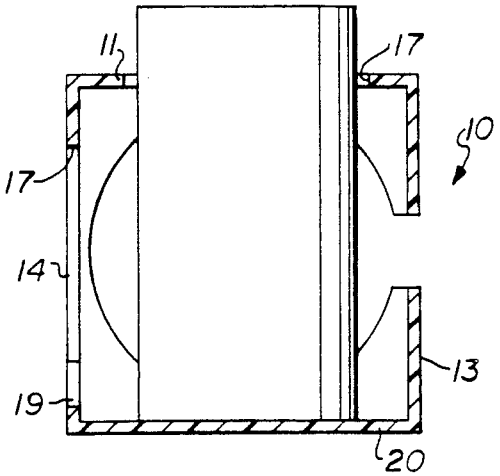
FIG. 8 is a cross sectional view of the holder with a cylindrical container received therein.

FIGS. 8–12 illustrate how various shaped containers may be slidably received and carried in the hollow holder 10. FIG. 8 is a cross sectional view of the hollow holder 10 with a cylindrical container or can received through the aperture in the top side wall. It should be understood that the hollow holder 10 would receive a bottle in the same manner.

Figure 9:
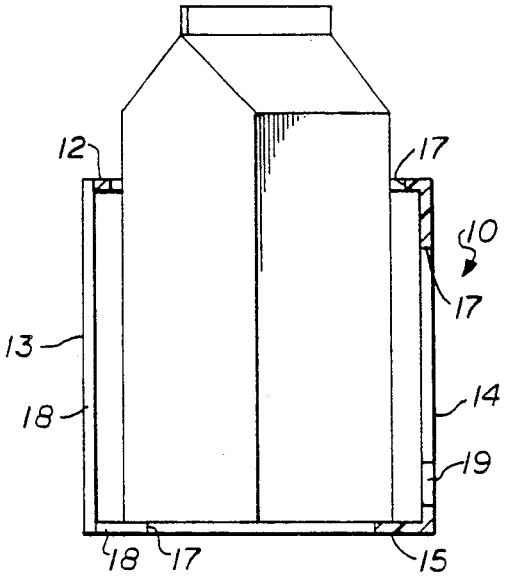
FIG. 9 is a cross sectional view of the holder with a square container received therein.
Figure 10:
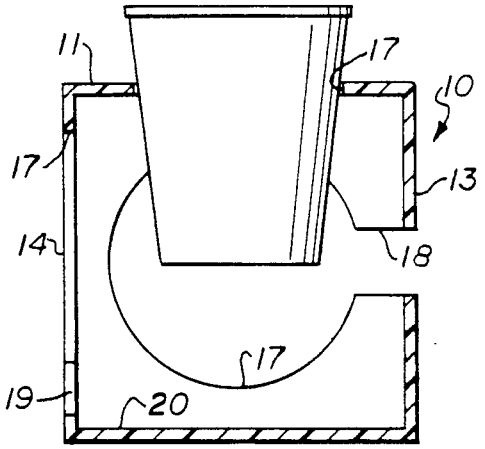
FIG. 10 is a cross sectional view of the holder with a cylindrical tapered container received therein.

FIG. 9 shows a square container, such as a milk carton received through the aperture 17 in the top side wall. By inverting the hollow holder to place the properly sized aperture on the top side, various other sizes and shapes may be accomodated. For example, in FIG. 10, a tapered or conical container is received in the aperture.

Figure 11:
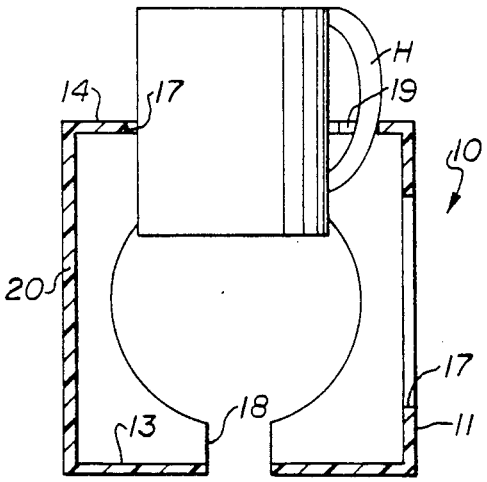
FIG. 11 is a cross sectional view of the holder with a cup having a handle received therein in which the bottom of the cup is resting on the bottom wall of the holder.
Figure 12:
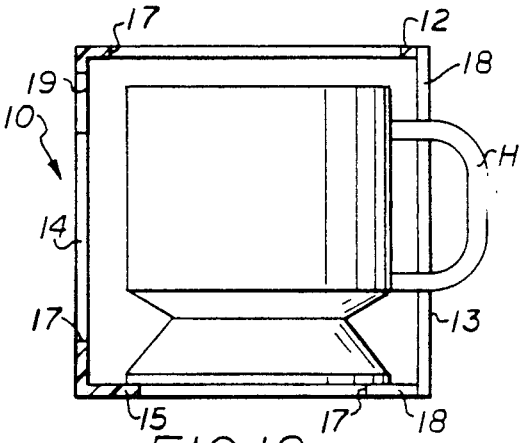
FIG. 12 is a cross sectional view of the holder with a cup having a handle received therein in which the cup handle is received in a slot through an adjacent side wall.

The hollow holder 10 will also readily accept containers having handles. FIG. 11 shows an example of a cup having a handle H received and frictionally engaged in the top side wall 14, and FIG. 12 shows a cup having a handle in which the bottom of the cup is resting on the bottom wall of the hollow holder 10 and the cup handle H is received in the slot 18 in the side wall 13.

Figure 13:
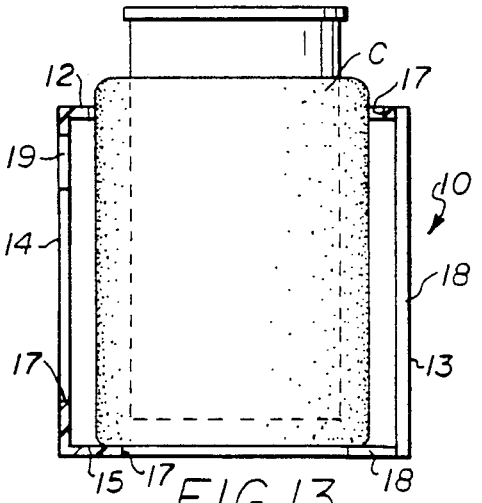
FIG. 13 is a cross sectional view of the holder with a can inside an insulated cooler received therein.

The invertible hollow holder 10 will also accept containers which are carried in insulated coolers C as shown in FIG. 13. This feature allows the beverages to be kept cool over an extended period of time, whereas most prior art beverage holders are of such size that the can must be removed from the cooler to be placed in the holder.

The holder, as described above, is used mainly for beverage containers, but is equally useful for containers containing other liquids or fluids or powders, etc., to protect against spilling.

While this invention has been described fully and completely with special emphasis upon a preferred embodiment, it should be understood that within the scope of the appended claims the invention may be practiced otherwise than as specifically described herein.

I claim:

1. A holder for beverage containers of a plurality of sizes and shapes comprising;

a hollow cube receptacle having six enclosed sides comprising a plurality of parallel side walls having apertures through four of the side walls thereof sized and shaped to receive containers of different size and shape, a fifth side wall having only a slotted opening extending continuously therein between two of said parallel side walls, and a sixth wall having no opening, first and second parallel side walls each having a single central circular opening with a slot extending from said circular opening to said fifth side wall and intersecting said fifth wall slotted opening to permit a beverage container handle to move therein to allow a beverage container to rest on the opposite side wall, a third side wall parallel to said fifth side wall and having a single circular opening with a slot extending from the opening toward a corner of said third side wall permitting a beverage container with a handle to rest therein, a fourth side wall parallel to said sixth side wall and having a single circular opening with no slot or other opening extending therefrom, said receptacle in use resting on said sixth side wall and exposing an upwardly facing fourth side wall with a beverage-container-receiving aperture, and said receptacle being manually invertible to expose a selective upwardly facing aperture for receiving a beverage container of certain size and shape.

* * * * *